US008079861B2

(12) United States Patent
Suzuki et al.

(10) Patent No.: US 8,079,861 B2
(45) Date of Patent: Dec. 20, 2011

(54) RELAY CONNECTOR

(75) Inventors: Teruhito Suzuki, Kouza (JP); Hideyuki Hirata, Yamato (JP); Koji Murakami, Sagamihara (JP); Cong Li, Dalian (CN)

(73) Assignee: Molex Incorporated, Lisle, IL (US)

( * ) Notice: Subject to any disclaimer, the term of this patent is extended or adjusted under 35 U.S.C. 154(b) by 43 days.

(21) Appl. No.: 12/225,614

(22) PCT Filed: Mar. 29, 2007

(86) PCT No.: PCT/US2007/007891

§ 371 (c)(1),
(2), (4) Date: Aug. 25, 2009

(87) PCT Pub. No.: WO2007/123666

PCT Pub. Date: Nov. 1, 2007

(65) Prior Publication Data

US 2010/0068938 A1 Mar. 18, 2010

(30) Foreign Application Priority Data

Mar. 29, 2006 (JP) ..... 2006-089873

(51) Int. Cl.
*H01R 13/15* (2006.01)

(52) U.S. Cl. ..... 439/260; 439/498

(58) Field of Classification Search ..... 439/260, 439/495, 498

See application file for complete search history.

(56) References Cited

U.S. PATENT DOCUMENTS

| | | | | |
|---|---|---|---|---|
| 4,252,389 | A * | 2/1981 | Olsson | 439/65 |
| 5,246,382 | A * | 9/1993 | Kerek et al. | 439/495 |
| 5,873,739 | A * | 2/1999 | Roberts | 439/67 |
| 5,906,498 | A * | 5/1999 | Nagafuji | 439/260 |
| 6,773,288 | B2 * | 8/2004 | Geltsch et al. | 439/329 |
| 7,083,454 | B2 * | 8/2006 | Suzuki | 439/260 |
| 7,241,167 | B2 * | 7/2007 | Yamada et al. | 439/498 |
| 7,367,837 | B2 * | 5/2008 | Pabst | 439/460 |
| 7,416,438 | B2 * | 8/2008 | Hashiguchi et al. | 439/495 |
| 7,452,227 | B2 * | 11/2008 | Matoba et al. | 439/260 |
| 7,713,078 | B2 * | 5/2010 | Nishimatsu et al. | 439/260 |
| 2002/0192999 | A1 * | 12/2002 | Geltsch et al. | 439/498 |
| 2004/0127092 | A1 | 7/2004 | Yamada et al. | |
| 2005/0136732 | A1 | 6/2005 | Suzuki | |
| 2010/0068938 | A1 * | 3/2010 | Suzuki et al. | 439/638 |

OTHER PUBLICATIONS

International Search Report for PCT/US07/007891, Sep. 25, 2007.

* cited by examiner

*Primary Examiner* — James Harvey
(74) *Attorney, Agent, or Firm* — Timothy M. Morella

(57) ABSTRACT

A flat flexible cable connector (10) has a housing (31) with an insertion opening (33) in its front face. Two lengths of flexible cable (51*a*, 51*b*) are placed end to end and are inserted into the opening. The connector has terminals (41) with top and bottom opposing contact portions (43*a*, 44*a*) which are aligned with the exposed conductive leads on the two lengths of flexible cables. A moveable actuator (11) applies pressure to the terminal contact portions to effect a reliable connection between the flexible cables.

3 Claims, 5 Drawing Sheets

FIG.6
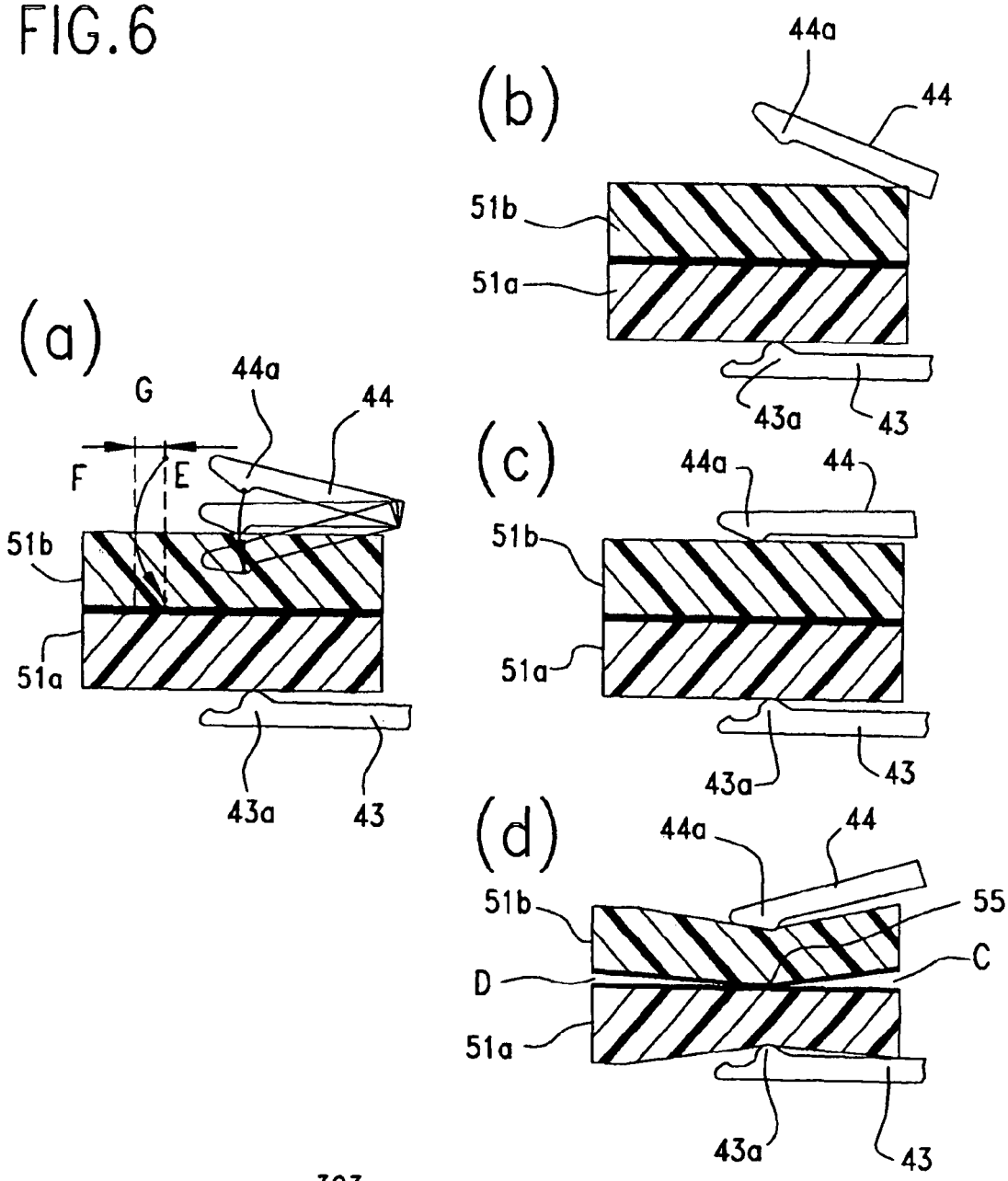
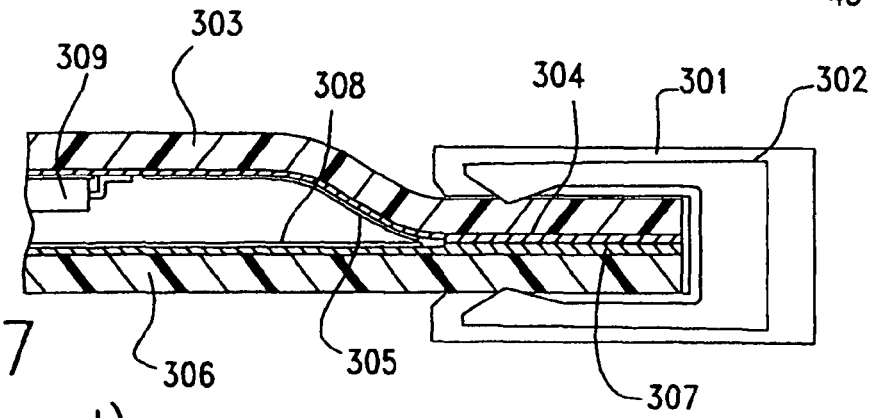
FIG.7
(Prior art)

RELAY CONNECTOR

RELATED CROSS-REFERENCES

The Present Disclosure is a U.S. National Phase Application of Patent Cooperation Treaty (PCT) Patent Application No. PCT/US2007/0007891, entitled "Relay Connector," filed with the United States Patent and Trademark Office, as Receiving Office for the PCT on 29 Mar. 2007. The PCT Application claims priority to prior-filed Japanese Patent Application No. 2006-089873, entitled "Relay Connector," filed on 29 Mar. 2006 with the Japanese Patent Office. The contents of each of the aforementioned Patent Applications are fully incorporated in their entireties herein.

BACKGROUND OF THE INVENTION

The present invention relates to a relay connector for not exclusively but preferably providing a connection between flat cables.

Conventionally, relay connectors provide electrical connection between flat cables, each having flexibility and being often referred to as a flexible printed circuit (FPC) or a flexible flat cable (FFC). One such connector is described in Japanese Patent Application Laid-open (kokai) No. 6-203932). FIG. 7 is a cross-sectional view illustrating an important part of such a conventional relay connector.

As shown in FIG. 7, the connector has a housing 301 formed of an insulating material, and a plurality of terminals 302 held by the housing 301 which are formed of a conductive material. The terminals 302 are securely mounted, by press-fit, in terminal holding grooves formed in a cable insertion opening of the housing 301. Each of the terminals 302 has, on each of the upper and lower sides thereof, a cantilever-like arm member extending from a main body seated in an innermost portion of the housing 301 toward the front face of the housing 301.

A first flat cable 303 and a second flat cable 306, with their one ends disposed to be stacked one upon another, are inserted into the cable insertion opening of the housing 301. The first flat cable 303 is provided with a plurality of conductive leads 304 formed on one surface (the lower surface as viewed in FIG. 7) of a body formed of a strip-shaped insulating material, and an insulating layer 305 covering the surfaces of the conductive leads 304. The second flat cable 306 is provided with a plurality of conductive leads 307 formed on one surface (the upper surface as viewed in FIG. 7) of a body formed of a strip-shaped insulating material, and an insulating layer 308 covering the surfaces of the conductive leads 307. An electronic component 309 is mounted on the first flat cable 303, and terminals of the electronic component 309 are connected to the conductive leads 304.

The insulating layer 305 is partially removed at the end of the first flat cable 303 to expose the conductive leads 304 thereof, and the insulating layer 308 is partially removed for the same purpose at the end of the second flat cable 306. Therefore, as shown in FIG. 7, by stacking the two ends of the cables together and inserting them as a single piece into the cable insertion opening of the housing 301, the conductive leads 304 and 307 contact each other to establish an electrical connection to thereby connect together the first flat cable 303 to the second flat cable 306. The upper and lower arm members of the terminals 302 urge the first flat cable 303 and the second flat cable 306 from above and from below, and the conductive leads 304 and 307 are pressed against each other to ensure a connection between the first and second flat cables 303 and 306. A lock member (not shown) may be fit from behind the housing 301 in order that the upper and lower arm members of the terminals 302 are further pressed from above and from below by the lock member. This provides a sure connection between the two flat cables 303 and 306.

Nevertheless, in the above connector, a change in the electrical connecting resistance between the conductive leads 304, 307 might cause a change in the transmission characteristics of signals. That is, the conductive leads 304 and 307 are pressed together and connected to each other by the upper and lower arm members of the terminals 302. However, according to careful observation of the connection of both conductive leads 304 and 307, it is understood that, at a point corresponding to projected portions of the above-mentioned arm members contact of both conductive leads is ensured, but in a region lying in front of and behind the point, both may be alternately brought into contact with one another and separated apart from one another because of the uncertainty of contacting state. When the region of both conductive leads 304 and 307 that lie in front of and behind the point is in contacting state, the area of a portion in such a contacting state is rather large thereby decreasing the electric connecting resistance between the conductive leads 304 and 307. When the above-mentioned region in front of and behind the point is separated apart to lose contact, the area of the portion in the contacting state becomes narrow thereby increasing the electric connecting resistance between the conductive leads 304 and 307. Thus, the change in the electric connecting resistance between both conductive leads 304 and 307 could cause unstable transmission characteristics, resulting in becoming unable to stably transmit signals.

SUMMARY OF THE INVENTION

The present invention has an object thereof to solve the above-mentioned problems, by providing a relay connector for flat cables having conductive leads exposed in a bare condition and mutually stacked so as to come face to face with each other. The connector includes terminals provided with pressing projections, a first arm portion and a second arm portion, each extending in a direction along which insertion and withdrawal direction of the flat cables are performed, and a connecting portion that connects the first arm portion and the second arm portion. Due to the described configuration, an attitude change of an actuator from a first position to a second position changes an angle of the first or second arm portion so that the pressing projection of the first arm portion or the pressing projection of the second arm portion is urged to displace toward a line of direction in which the insertion is performed. This results in the conductive leads of the respective flat cables forming together a contact point at a position corresponding to the pressing projections, and that these conductive leads are spaced apart when they come apart from the contact point in the insertion direction. Consequently, the connecting resistance between both conductive leads is constant, enabling acquirement of stable transmission characteristics of signals.

To this end, a relay connector of the present invention includes: a housing provided with an insertion opening for permitting insertion of a first flat cable and a second flat cable having conductive leads exposed in a bare condition and stacked so as to come face to face with each other; terminals that are loaded into the housing, and which urge the first and second flat cables from both sides; and, an actuator secured to the housing which is movable between a first position for permitting insertion of the first and second flat cables, and a second position for effecting the electrical connection between conductive leads of the first and second flat cables.

Each terminal is provided with pressing projections that press the first and second flat cable from both sides, and also has first and second arm portions that extend in an insertion direction of the first and second flat cables, and a connecting portion for connecting the first arm portion and the second arm portion. A change in movement of the actuator from the first to second position, causes a change in an angle of the first or second arm portion so that either the pressing projection of the first arm portion or the pressing projection of the second arm portion are displaced toward a line of a direction in which the insertion is performed.

In a relay connector according to another embodiment of the invention, a clearance is defined between opposite surfaces of the first and second cables at tips thereof inserted into the insertion opening due a change in movement of the actuator from the first to the second position thereof.

Further, in still another embodiment of the present invention, the conductive leads of the first and second flat cables inserted into the insertion opening form contact points where the conductive leads contact each other at a position corresponding to the pressing projections due to a change in movement of the actuator from the first to second position thereof.

In a further embodiment of the present invention, the conductive leads of the first and second flat cables inserted into the insertion opening, are mutually kept apart except for at the contact point thereof.

In accordance with the present invention, the relay connector is adapted for flat cable insertion with conductive leads exposed in a bare condition and stacked to come face to face with each other, has pressing projections, and a first and second arm portion, each extending along the insertion direction of the flat cables, and terminals each for connecting the first arm portion and the second arm portion. Movement of the actuator from the first position to the second position changes the angle of the first or second arm portion so that the pressing projections of the first or second arm portions are displaced in the insertion direction. The leads of the respective flat cables are formed at contact points at the position corresponding to the pressing projections, and that these leads are spaced apart in the insertion direction from the contact point. Consequently, the connection resistance between the leads is constant, permitting stable transmission characteristics of signals.

BRIEF DESCRIPTION OF THE DRAWINGS

FIGS. 6A to 6D are diagrams schematically explaining the operation of terminals of the relay connector of the preferred embodiment of the present invention; and FIG. 7 is a cross-sectional view of a conventional relay connector.

DESCRIPTION OF THE PREFERRED EMBODIMENTS

Figure 3:
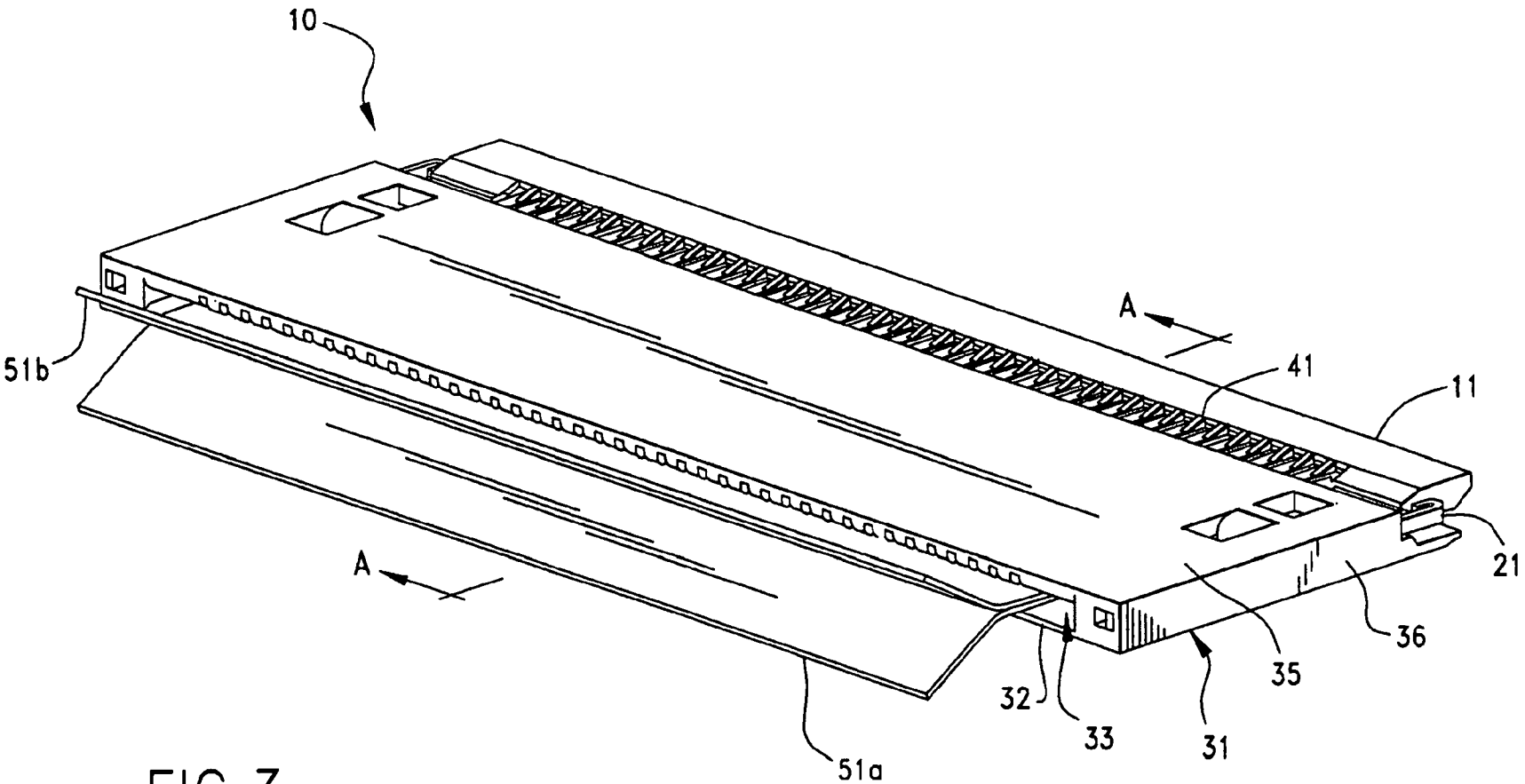
FIG. 3 is a perspective view of the relay connector of FIG. 1 with the actuator in its closed position.

In these drawing figures, the reference numeral 10 designates a connector which is a relay connector according to the present embodiment, which is used to provide connection between a first flat cable 51*a* and a second flat cable 51*b* that are called flexible printed circuits, flexible flat cables, or the like. In the present embodiment, the first flat cable 51*a* and the second flat cable 51*b* are connected to each other by inserting them into the connector 10, with their respective ends stacked upon each other as shown in FIG. 3. The first and second flat cables 51*a* and 51*b* are stacked so that their surfaces on which conductive leads are formed, come face to face with each other. The cables 51*a* and 51*b* are of the same construction, and accordingly hereinafter, they will be commonly referred to as "flat cables 51". Although the flat cables 51 are flat flexible cables called such as FPC, FFC, or the like, they may be of any type of flat cable provided with conductive leads.

The connector 10 has a housing 31 integrally formed of an insulating material, and an actuator 11 that is also formed of an insulating material, and which is secured to the housing 31 so as to move thereon. That is to say, the actuator 11 is secured to the housing 31 so that it is able to move between an open position (first position), and a closed position (second position).

Figure 1:
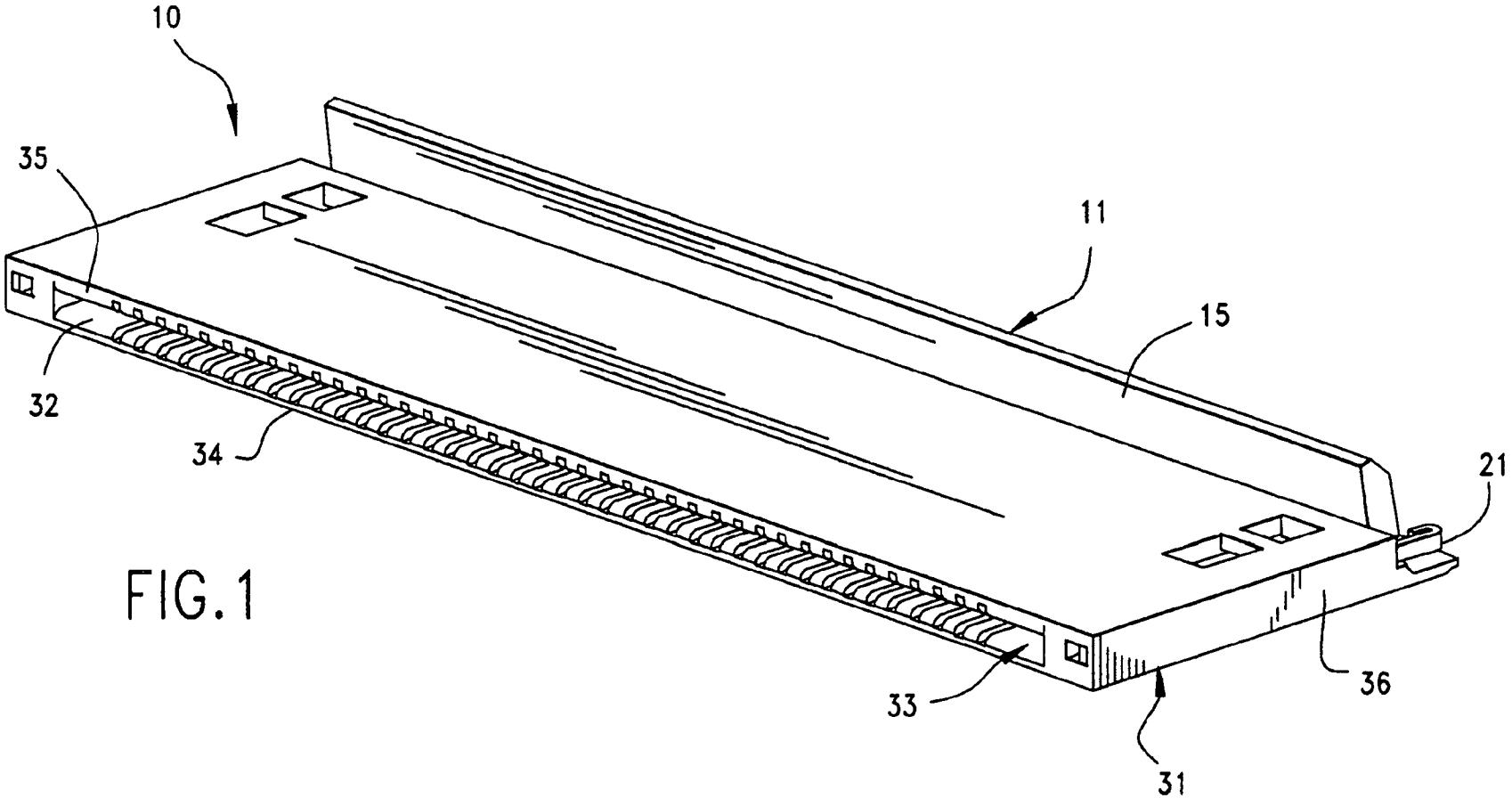
FIG. 1 is a perspective view of one embodiment of the present invention with its actuator in its open position.
Figure 4:
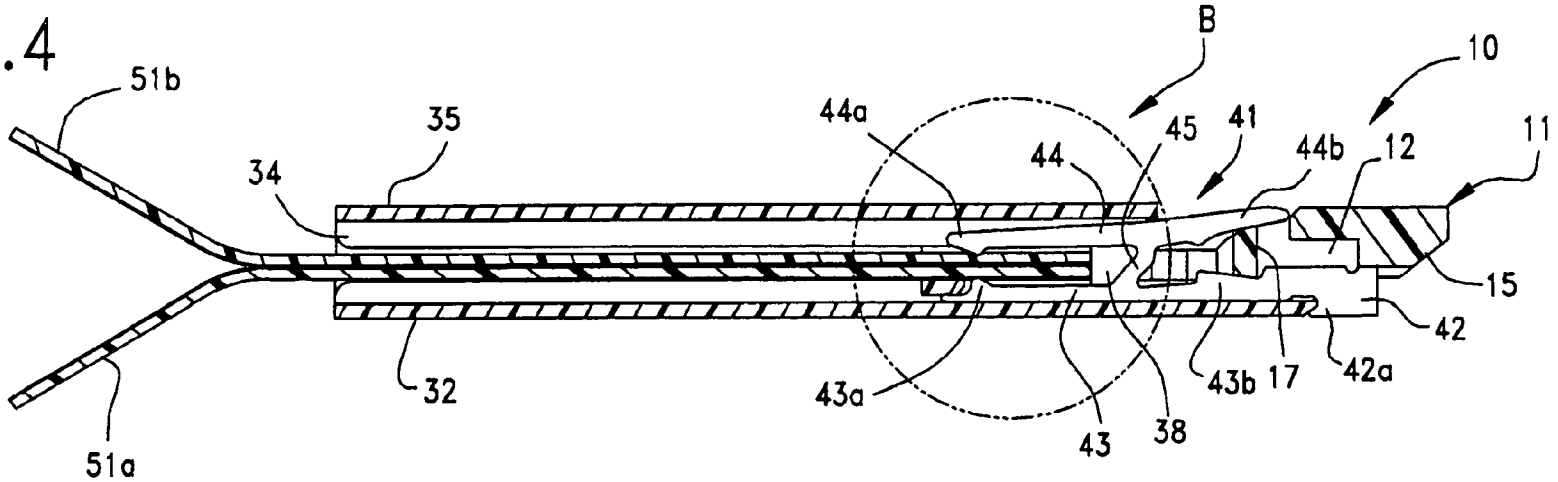
FIG. 4 is a sectional view of the connector of FIG. 3 taken along A-A thereof.
Figure 5:
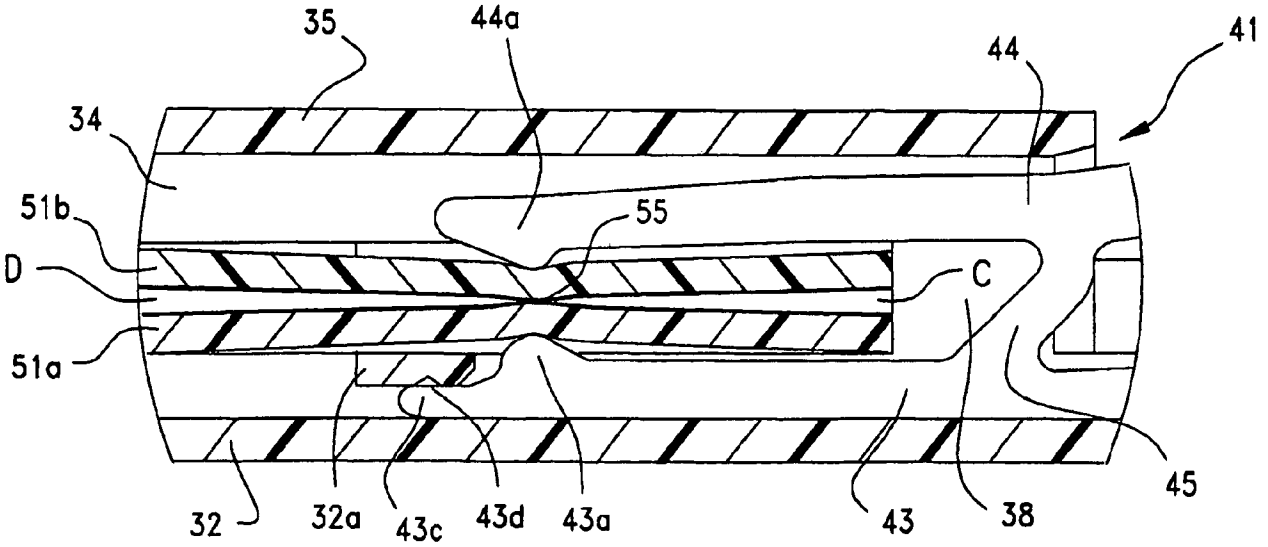
FIG. 5 is an enlarged detail view of area B of FIG. 4, with the actuator closed.

The housing 31 has a lower part 32, an upper part 35, right and left side parts 36, and an insertion opening 33, through which one end of each flat cable 51 is inserted from front (obliquely lower on the left as viewed in FIG. 1). The opening is formed among the lower part 32, the upper part 35, and the side parts 36. The insertion opening 33 is provided with a plurality of terminal receiving grooves 34, in which conductive terminals are loaded. In the interior of the opening 33, as shown in FIGS. 4 and 5, an abutting part 38, against which the tips of the flat cables 51 abut, is disposed between the neighboring terminal receiving grooves 34. At this stage, for example, a total of forty such terminal grooves 34 are formed at a pitch of approximately 0.3 mm. The pitch and the number of the terminal grooves 34 may be suitably changed. The terminal receiving grooves 34 are not necessarily required to be entirely loaded with the terminals 41. Thus, several terminals 41 may be omitted suitably depending upon the array of the conductive leads of the flat cables 51.

Stoppers 21, in the form of auxiliary metal brackets, are loaded into both sides of the housing 31. The stoppers 21 prevent the actuator 11 from being disengaged from the housing 31. The stoppers 21 stop the movement of the actuator 11 by engaging side projections of the actuator 11.

The actuator 11 has a body portion 15 that is a substantially rectangular plate member, a plurality of terminal holes 12 formed in the body portion 15, and shafts 17 formed in the terminal holes 12. As shown in FIG. 4, an actuating lever portion 44*b* of the upper arm portion 44 of each terminal 41 is held in each of the terminal holes 12.

Referring to FIGS. 4 and 5, each terminal 41 has a substantially H-shape, and has a lower arm portion 43 as a first arm portion, and the upper arm portion 44 as a second arm portion, which extend in opposite insertion and withdrawal direction of the flat cable 51, namely back and forth in the housing 31, and an elongated strip-shaped connecting portion 45 that connects the lower arm portion 43 and the upper arm portion 44. The connecting portion 45 is connected to a position between the lengthwise opposite ends of the lower arm portion 43, and also connected to a position between the lengthwise opposite ends of the upper arm portion 44. Here, the upper arm portion 44 is disposed above the lower arm portion 43.

The lower arm portion 43 has a tip-projecting portion 43*c* that projects forward from the side of the connecting portion 45, a cable supporting portion 43*a* provided as a pressing projection protruding upward, and a bearing portion 43*b*. The cable supporting portion 43*a* are arranged at a position adjacent to the tip end of the lower arm portion 43 and disposed behind the tip projecting portion 43*c*, and the bearing portion 43*b* is connected to a position located behind the point at which the lower arm 43 is connected to the connecting portion 45, and supports the shafts 17 from below. A tail portion 42 is connected to the rear end of the bearing portion 43*b*. Since the tail portion 42 projects downward at a portion thereof, as required, it may also be used as a substrate connecting portion to be connected to a connecting pad formed on a surface of the substrate by soldering or the like. The tip projecting portion 43*c* is formed, at its upper end thereof, with a projection 43*d* projecting upward.

Each of the terminals 41 is inserted into a corresponding terminal groove 34 from the back side of the housing 31 (the right side in FIG. 4). Each terminal 41 is secured to the housing 31 as follows. A substantially linear lower end of the lower arm portion 43 abuts against a floor surface of the terminal groove 34, and the tip projecting portion 43*c* is press-fit between the lower surface of a terminal supporting member 32*a* disposed in the terminal groove 34 and the floor surface of the terminal groove 34, and the projection 43*d* grips a portion of a ceiling surface of a lower surface hole portion of the terminal supporting member 32*a*, and further a projection 42*a* of the tail portion 42 grips a lower end of a rear edge at the lower part 32 of the housing 31.

The upper arm portion 44 functions as a movable pressing member that presses the flat cables 51 against the lower arm portion 43, and has, in the vicinity of the tip thereof, a cable pressing portion 44*a* in the form of a pressing projection protruding downward. The upper arm portion 44 is further provided with an actuating lever portion 44*b* that extends toward the rear beyond the point at which the upper arm portion 44 is connected to the connecting portion 45. The actuating lever portion 44*b* is arranged to enter into the terminal hole 12 of the actuator 11 thereby to control any upward movement of the shaft 17.

Each of the shafts 17 is elliptical or rectangular in cross-section, and is interposed between the bearing portion 43*b* and the actuating lever portion 44*b*. Each shaft 17 functions as a cam when it is rotated. In the open position, the shaft 17 pushes up the actuating lever portion 44*b* because it is positioned substantially a right angle, as shown in FIG. 4. When the actuating lever portion 44*b* is pushed up, the connecting portion 45 and its surroundings are resiliently deformed, and the entire upper arm portion 44 is rotated to change a relative angle defined between the upper arm portion 44 and the lower arm portion 43, so that the tip of the upper arm portion 44 is shifted downward. Thus, the cable pressing portion 44*a* is shifted coming close to the cable supporting portion 43*a*, and is then pressed against the flat cables 51.

When the actuator 11 is in the open position, the shaft 17 is positioned at an angle of substantially level position, so that the actuating lever portion 44*b* is not pushed up, and the tip of the upper arm portion 44 is not shifted downward. Therefore, a sufficiently large space is provided between the cable pressing portion 44*a* and the cable supporting portion 43*a*, thereby enabling the ends of the flat cables 51 to be inserted in the opening 33 under no or slight contact pressure from the cable pressing portion 44*a* and the cable supporting portion 43*a*. This realizes a substantially DT (zero insertion force) structure.

A description of the operation of connecting the flat cables 51 will be provided hereinbelow.

FIG. 6 schematically explains the operation of the terminals of the relay connector of the present invention.

In each first and second flat cable 51*a*,51*b*, a plurality of forty conductive leads in the shape of a foil having conductivity are arranged side by side at a predetermined pitch, for example, about 0.3 mm, on an insulating layer exhibiting electrical insulating property. Another insulating layer covers the upper surfaces of the conductive leads. On the side of the end portion of the first flat cable 51*a* and the end portion of the second flat cable 51*b* which are inserted into the insertion opening 33 of the connector 10 (their respective right end portions as viewed in FIG. 4), namely on the side of the tip portion, the insulating layers are removed to expose the upper surfaces of the conductive leads in a bare condition over a predetermined range of length from the respective extreme tips. On the side of the tip portions of the first and second flat cables 51*a* and 51*b*, their respective surfaces where the conductive leads are arranged are stacked in face-to-face relationship. Specifically, in the range of barely exposed the upper surfaces of the conductive leads, the conductive leads of the first and second flat cables 51*a*,51*b* are stacked face to face with each other. At this stage, the tips of the first and second flat cable 51*a*,51*b* may be provided, on both sides thereof, with ears (not shown) formed to project outward, respectively.

Figure 2:
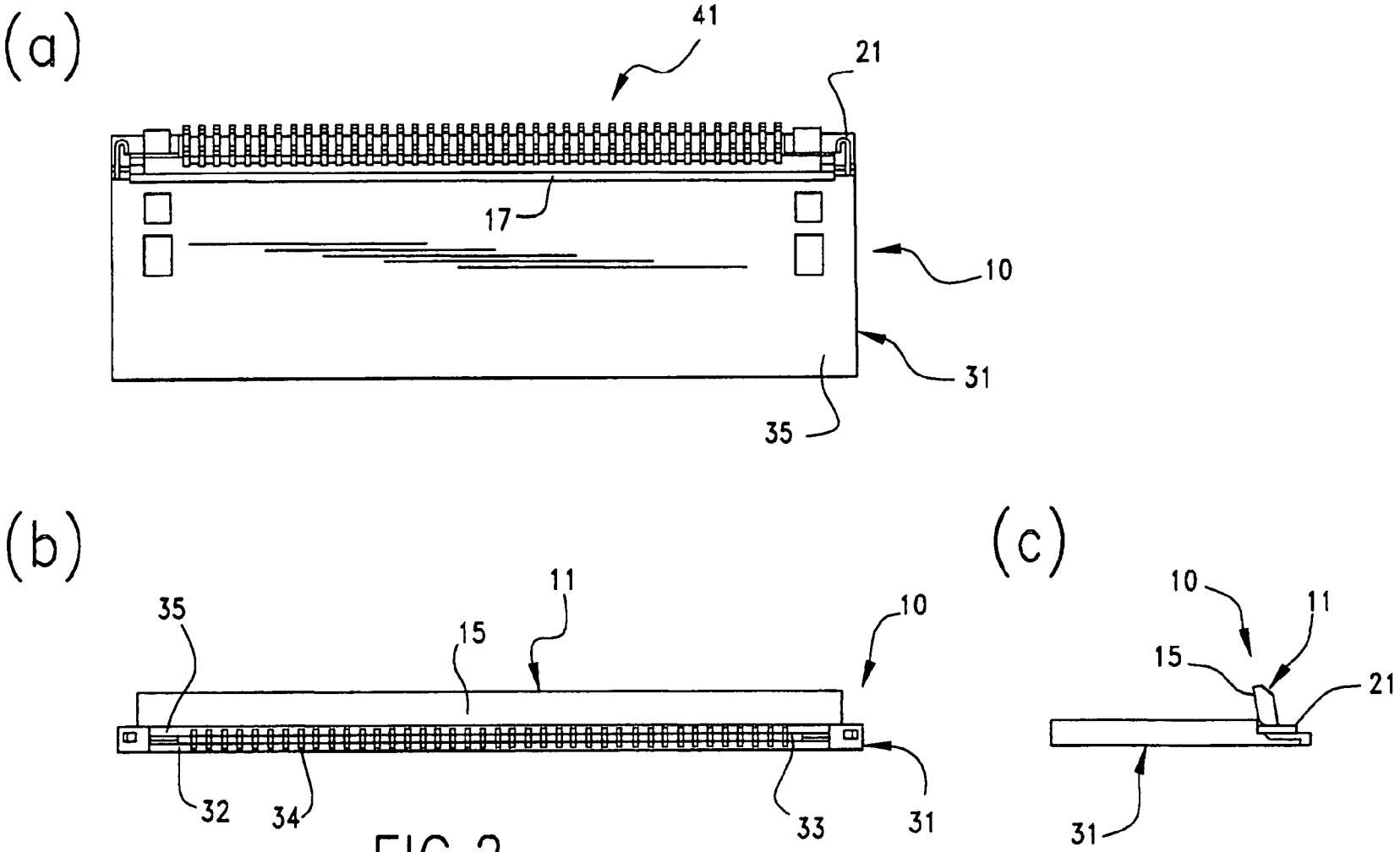
FIGS. 2A to 2C are a top view, a front view, and a side view of the relay connector of FIG. 1.

An operator inserts the respective tips of the first and second flat cables stacked together, into the insertion opening 33 of the housing 31. As shown in FIGS. 1 and 2, the actuator 11 is brought into the open position thereof in advance. Therefore, a predetermined range from the extreme tips of the first and second flat cables 51*a* and 51*b* can be inserted into between the upper arm portion 44 and the lower arm portion 43 of each terminal 41 held within the corresponding terminal groove 34.

Although in the example shown in the drawings, the first flat cable underlies the second flat cable, the first flat cable may overlie the second flat cable. The tips of the first and second flat cable each abut against the abutting part 38 positioned within the terminal groove 34. Thus, the lengthwise positioning of the flat cables 51 is performed, so that the insertion of the first and second flat cables is completed.

Subsequently, the operator manually operates the actuator 11 to change the open position of the actuator 11 (FIG. 1) into the closed position (FIG. 3). At this time, the actuator 11 is shifted in a clockwise direction in FIG. 2C to thereby be able to change its movement into the closed position.

The body portion 15 of the actuator 11 is rotated to produce a state substantially parallel to the insertion direction of the first and second flat cables, as shown in FIGS. 3 and 4. The shaft 17 is also rotated to a substantially right angle, as shown in FIG. 4. That is, the major axis of substantially elliptical or rectangular cross-section of the shaft 17 is positioned at a substantially right angle.

Therefore, by the shaft 17, the space between the bearing portion 43*b* and the actuating lever portion 44*b* is spaced apart, and the actuating lever portion 44*b* is pushed upward. Accordingly, the connecting portion 45 and its surroundings are resiliently deformed, and the entire upper arm portion 44 is rotated to change the relative angle defined between the upper arm portion 44 and the lower arm portion 43, so that the tip of the upper arm portion 44 is shifted downward. Thus, the cable pressing portion 44*a* is shifted coming close to the cable supporting portion 43*a*, and is then pressed against the upper surface of the second flat cable 51*b*, namely a surface opposite to the surface on which the conductive leads are arranged. As a result, the conductive leads barely exposed on the lower surface of the second flat cable 51*b* are pressed against the conductive leads barely exposed on the upper surface of the first flat cable 51*a*.

In this case, since the cable supporting portion 43*a* exists at a position opposed to the cable pressing portion 44*a*, the cable supporting portion 43*a* is pressed against the lower surface of the first flat cable 51*a*, namely the surface opposite to the surface having the conductive leads. As a result, the first and second flat cables are urged to a condition where they are sandwiched together from above and below by the cable pressing portion 44*a* and the cable supporting portion 43*a*. As best shown in FIG. 5, the conductive leads barely exposed on the upper surface of the first flat cable 51*a*, and the conductive leads exposed on the lower surface of the second flat cable 51*b* form a contact point 55 to provide a reliable electrical connection at a position corresponding to the cable supporting portion 43*a* and the cable pressing portion 44*a*.

On the other hand, on the side behind the contact point 55, namely on the fore side viewing in the direction of insertion (i.e., the right side as viewed in FIG. 5), the upper surface of the first cable 51*a* and the lower surface of the second cable 51*b* are spaced apart to leave a clearance C therebetween. On the side located in front of the contact point 55, the leads of the first cable 51*a* and the leads of the second cable 51*b* are spaced apart to provide no electrical connection. Likewise, on the side in a counter-insertion direction from the contact point 55, namely on the rear side of the contact point 55, the upper surface of the first cable 51*a* and the lower surface of the second cable 51*b* are spaced apart to leave a clearance D. That is to say, on the rear side of the contact point 55, the conductive leads of the first cable 51*a* and the conductive leads of the second cable 51*b* are also spaced apart to provide no electrical connection.

This is because, when the cable pressing portion 44*a* of the upper arm portion 44 is pressed against the upper surface of the second flat cable 51*b*, it is displaced in the insertion direction, namely toward the front end of the second flat cable 51*b*. In the present embodiment, the dimension and the shape of the terminals 41 are adjusted in order to achieve the following movements. That is, when the cable pressing portion 44*a* is moved to come close to the cable supporting portion 43*a* in response to the attitude change of the actuator 11 from the open position to the close position thereof, the position of the cable pressing portion 44*a* with respect to the insertion direction is shifted rightward as viewed in FIG. 5, from the time that the cable pressing portion 44*a* contacts with the upper surface of the second flat cable 51*b* until completion of the movement thereof.

FIGS. 6A-6D schematically and exaggeratedly illustrate the relationship between the movement of the upper arm portion 44 and the flat cables 51 when the cable pressing portion 44*a* is pressed against the upper surface of the second cable 51*b*. Specifically, FIG. 6A illustrates the movement of the upper arm portion 44. FIG. 6B illustrates a state before the cable pressing portion 44*a* contacts with the upper surface of the second cable 51*b*. FIG. 6C illustrates a state in which the cable pressing portion 44*a* is in contact with the upper surface of the second cable 51*b*. FIG. 6D illustrates a state in which the actuator 11 is in the close position, and the cable pressing portion 44*a* is pressed against the upper surface of the second cable 51*b*.

When the actuator 11 is open, as shown in FIG. 6B, the tip (its left end in the figures) of the upper arm portion 44 is directed to obliquely above. That is to say, on the basis of the direction of extension of the lower arm portion 43, the elevation angle when the tip is viewed from the center of rotation of the upper arm portion 44, namely the elevation angle of the extension direction of the upper arm portion 44 has a plus value.

Subsequently, when the movement of the actuator 11 is changed from an open to a closed position, the entire upper arm portion 44 is rotated to change the relative angle defined between the upper arm portion 44 and the lower arm portion 43. As a result, the elevation angle of the extension direction of the upper arm portion 44 on the basis of the extension direction of the lower arm portion 43 is reduced, and the tip of the upper arm portion 44 is shifted downward. When the elevation angle is zero, as shown in FIG. 6C, the cable pressing portion 44*a* is brought into contact with the upper surface of the second flat cable 51*b*.

Subsequently, when the tip of the upper arm portion 44 is shifted further downward, the elevation angle of the extension direction of the upper arm portion 44 on the basis of the extension direction of the lower arm portion 43 has a minus value, thereby increasing the absolute value of the elevation angle. When the actuator 11 is moved to the close position, as shown in FIG. 6D, the cable pressing portion 44*a* is brought into contact with the upper surface of the second flat cable 51*b*.

In this state, the elevation angle of the extension direction of the upper arm portion 44 on the basis of the extension direction of the lower arm portion 43 has a minus value having a large absolute value. The conductive leads barely exposed on the upper surface of the first cable 51*a* and the leads on the lower surface of the second cable 51*b* form contact points 55 to provide electrical connection therebetween in a manner such that the leads of the first and second flat cables confront, the cable supporting portion 43*a* and the cable pressing portion 44*a*, respectively. On the side in the insertion direction from the contact point 55, the upper surface of the first cable 51*a* and the lower surface of the second cable 51*b* are spaced apart to leave the clearance C. On the side in the counter-insertion direction from the contact point 55, the upper surface of the first flat cable 51*a* and the lower surface of the second flat cable 51*b* are spaced apart to leave the clearance D.

FIG. 6A illustrates the movements of the upper arm portion 44 shown in FIGS. 6B-6D. The arrow E indicates the locus along which the cable pressing portion 44*a* is moved. The arrow F represents exaggeratedly the curvature of the arrow E by way of explanation. It will be seen from the arrow F that the cable pressing portion 44*a* is displaced by a distance G in the insertion direction, namely toward the front end of the flat cables 51, from a state in which the cable pressing portion 44*a* is in contact with the upper surface of the second flat cable 51*b* as shown in FIG. 6C, until a state in which the cable pressing portion 44*a* is pressed against the upper surface of the second flat cable 51*b* as shown in FIG. 6D.

Thus, the angle of the upper arm portion 44 is changed, and the cable pressing portion 44*a* is displaced in the insertion direction after making a contact with the upper surface of the second flat cable 51*b*. Hence, on the side in the insertion direction from the contact point 55, the upper surface of the first flat cable 51*a* and the lower surface of the second flat cable 51*b* are spaced apart to leave the clearance C. This can be considered as follows. That is, the body of the first cable 51*a* and the body of the second cable 51*b* are flat members formed of material that is somewhat soft and has elastoplasticity, such as synthetic resin. Therefore, when a pin-point narrow range of the two bodies in the stacked state is pressed from above and from below, these bodies in this range are deformed so as to be in tight contact with each other, and the rest is deformed so as to separate from each other due to the affect of the deformation in this range. It can also be considered that because the upper surface of the second flat cable 51*b* is deformed in the insertion direction by the cable pressing portion 44*a*, the members constituting the bodies of the first and second flat cables are slightly slid in the insertion direction, thereby leaving the large clearance C on the side in the insertion direction from the contact point 55. On the other hand, it seems that such a slight sliding of the above-mentioned members in the insertion direction leaves the clearance D smaller than the clearance C in the counter-insertion direction from the contact point 55.

When the actuator 11 is closed, the leads exposed on the upper surface of the first cable and the conductive leads exposed on the lower surface of the second cable are connected to each other to establish electrical continuity at the contact point 55. Whereas in the range other than the contact point 55, the two cables have no contact, thus causing no variation in the electric connecting resistance between the leads of the first and second flat cables. That is, the connecting resistance therebetween can be stabilized to produce stable transmission characteristics of signals.

The extent of the first and second flat cables in which the insulating layers are removed to expose the upper surfaces of the conductive leads is a predetermined range from the extreme tip of the two cables. This range is slightly longer than the length from the abutting part 38 to the cable pressing portion 44*a* and the cabling supporting portion 43*a* in the terminal receiving grooves 34. Therefore, the range in which the conductive leads are exposed is short on the side in the counter-insertion direction from the contact point 55. Hence, even if the clearance D is small, there is no possibility of contact between the leads of the first and second flat cables.

On the other hand, on the side in the insertion direction from the contact point 55, the range in which the conductive leads are exposed is long enough to permit the leads to be exposed on the surfaces of the first and second cables over the entire range from the contact point 55 to the tip. However, the displacement of the cable pressing portion 44*a* in the insertion direction enables to leave a large amount of clearance C, thus eliminating any possibility of causing contact between the conductive leads barely exposed on the upper surface of the first flat cable 51*a* and the conductive leads barely exposed on the lower surface of the second flat cable 51*b*.

Although the case where the elevation angle in the extension direction of the upper arm portion 44 on the basis of the extension direction of the lower arm portion 43 is changed from plus to minus was described in detail by referring to FIGS. 6A to 6D, it should be noted that the relative angle change between the upper arm portion 44 and the lower arm portion 43 is not limited to this. It is possible to employ any alternative way in which the displacement of the cable pressing portion 44*a* in the insertion direction allows for displacement of the upper surface of the second flat cable 51*b* in the insertion direction. For example, where the elevation angle in the extension direction of the upper arm portion 44 on the basis of the extension direction of the lower arm portion 43 has a minus value, the attitude change of the actuator 11 from the open position to the close position may change the elevation angle into a minus value having a large absolute value.

Although in the foregoing description, the upper arm portion 44 is rotated by the movement of the actuator 11, the lower arm portion 43 may be rotated. In this case, the cable supporting portion 43*a* approaches the cable pressing portion 44*a* and displaces in the insertion direction, allowing the lower surface of the first flat cable 51*a* to be displaced in the insertion direction.

Thus, in the foregoing embodiment, each terminals 41 has a cable supporting portion 43*a* and a cable pressing portion 44*a* that press the first and second flat cables from opposite sides. The movement of the actuator 11 from the open to the closed position changes the angle of the lower arm portion 43 or the upper arm portion 44 so that the cable supporting portion 43*a* or the cable pressing portion 44*a* is displaced in the insertion direction.

Thus, the conductive leads of the first and second flat cables form a contact point 55 and make contact with each other where the conductive leads confront the cable supporting portion and the cable pressing portions. These leads are spaced apart except for the contact point 55. This enables the electrical resistance between these conductive leads to be kept constant, permitting stable transmission characteristics of signals.

Particularly, provision of the large amount of clearance C between the opposed surfaces at the extreme tip of the first flat cable 51*a* and the extreme tip of the second flat cable 51*b* ensures a reliable prevention of any contact between the conductive leads except for at the contact point 55.

It is to be understood that the present invention is not limited to the foregoing embodiment but various changes and modifications will occur to a person skilled in the art, based on the concept of the present invention, which may be considered as coming within the scope of the present invention as claimed in the appended claims.

What is claimed is:

1. A relay connector comprising:

a housing, the housing including an insertion opening for receiving a first flat cable and a second flat cable, the exposed leads of the first and second flat cables being arranged face to face with each other;

a plurality of terminals, each terminal being supported by the housing and arranged to hold the first and second flat cables together in a sandwiched manner from both sides, each terminal including pressing projections capable of pressing the first and second flat cables from opposite sides, a first arm portion and a second arm portion that extend in insertion and withdrawal directions of the first and second flat cables, and a connecting portion for connecting the first arm portion and the second arm portion; and an actuator, the actuator being secured to the housing and moveable between a first position, permitting insertion of the first and second flat cables into the housing, and a second position, which effects an electrical connection between conductive leads of the first and second flat cables;

wherein a change in movement of the actuator from the first to the second position causes a change in an angle of the first or second arm portions so that the pressing projection of the first arm portion or pressing projection of the second arm portion is displaced toward a line of direction in which the cable insertion is performed, and creates a clearance between opposite surfaces of tip ends of the first and second flat cables.

2. The relay connector of claim 1, wherein the movement of the actuator from the first position to the second position thereof further allows the conductive leads of the first and second cables, inserted from the insertion opening, to form a contact point at which both the conductive leads contact each other at a position in the connector where the conductive leads press and resist against a force of the pressing projections.

3. The relay connector of claim 2, wherein the conductive leads of the first and second flat cables are spaced apart from one another except for at the contact point.

* * * * *